United States Patent [19]

Schiller

[11] Patent Number: 5,012,596

[45] Date of Patent: May 7, 1991

[54] SHOE

[76] Inventor: Joan E. Schiller, 5294 Bridge Water Dr., Lyndhurst, Ohio 44124

[21] Appl. No.: 377,896

[22] Filed: Jul. 10, 1989

[51] Int. Cl.[5] ..... A43B 3/12; A43B 13/14

[52] U.S. Cl. ..... 36/11.5; 36/25 R

[58] Field of Search ..... 36/11.5, 103, 104, 33, 36/81, 25 R, 97, 1

[56] References Cited

U.S. PATENT DOCUMENTS

| | | | |
|---|---|---|---|
| 1,417,170 | 5/1922 | Hosmer . | |
| 1,960,418 | 3/1934 | Schaller | 36/71 |
| 2,083,581 | 6/1937 | Silver | 36/71 |
| 2,386,911 | 10/1945 | Sanchioni | 36/11.5 |
| 2,421,181 | 6/1947 | Tibiletti | 36/11.5 |
| 2,532,638 | 12/1950 | Niccoli | 36/33 |
| 2,599,740 | 6/1952 | Beveridge | 36/11.5 |
| 3,161,970 | 12/1964 | Purtell | 36/43 |
| 3,228,124 | 1/1966 | Schwarz | 36/11.5 |
| 3,352,033 | 11/1967 | Colley | 36/11.5 |
| 3,468,040 | 9/1969 | Fukuoka | 36/11.5 |
| 3,552,039 | 1/1971 | Fukuoka | 36/11.5 |
| 4,069,601 | 1/1978 | Robbins et al. | 36/104 |
| 4,084,333 | 4/1978 | Del Vecchio | 36/43 |
| 4,124,946 | 11/1978 | Tomlin | 36/43 |
| 4,302,861 | 12/1981 | Coppock | 36/11.5 |
| 4,425,721 | 1/1984 | Spronken | 36/11.5 |
| 4,510,702 | 4/1985 | Ehrlich, Jr. | 36/11.5 |
| 4,535,534 | 8/1985 | De Obaldia B. | 36/11.5 |

FOREIGN PATENT DOCUMENTS

| | | | |
|---|---|---|---|
| 2715906 | 6/1978 | Fed. Rep. of Germany | 36/11.5 |
| 488390 | 9/1918 | France | 36/81 |
| 366446 | 7/1930 | United Kingdom | 36/11.5 |

*Primary Examiner*—Steven N. Meyers

*Attorney, Agent, or Firm*—Renner, Otto, Boisselle & Sklar

[57] ABSTRACT

A high-heeled shoe, and method for making the same, the shoe being characterized by providing a substantially flat supporting area for a wearer's foot while appearing to support the foot at an angle. The shoe comprises a sole portion forming a supporting area for a wearer's foot, a heel joined with the sole portion extending perpendicularly downward at least an inch from the sole portion, and securing means for selectively securing the sole portion to a wearer's foot. A forefoot area of the sole portion is elevated to a level substantially horizontal with the heel area whereby the supporting area is generally flat. To make such a high-heeled shoe, a conventional last is altered to add bulk to a heel portion of the last whereby a negative cast of a sole will have a sunken heel. A structural sole portion in then cast. An upper midsole layer and a lower midsole layer are formed, and the upper midsole layer is attached to the structural sole portion. An upper rear portion, an upper front portion, and a heel are attached to the upper midsole layer. The lower midsole layer is then attached to the upper midsole layer.

7 Claims, 2 Drawing Sheets

SHOE

The present invention relates generally to footwear and, more particularly, to a shoe which presents a high fashion appearance while providing the support and comfort of a shoe that is generally flat or horizontally oriented.

BACKGROUND OF THE INVENTION

Throughout the centuries, footwear has evolved from fulfilling only the functional purpose of protecting feet to a significant fashion factor in a person's wardrobe. People, women in particular, often consider shoes an essential element in complementing their appearance. Shoe styles and footwear fashions have changed over the years, sometimes as often as seasonally. However, fashionable footwear for women almost always includes the high-heeled shoe.

Despite the stylish appeal of high-heeled shoes, they are not without disadvantages. In a flat shoe, the foot is supported in a substantially horizontal orientation. This horizontal orientation allows the wearer's own weight to be uniformly distributed over substantially the entire sole of the foot, thereby increasing stability and comfort. In contrast, high-heeled footwear elevates the heel portion of a person's foot relative to the rest of the foot. Instead of the foot being horizontally oriented and securely supported in the shoe, the foot is supported on an angle and usually is less stable. The angle at which the foot is supported relative to the ground is due to the angled or sloped contour of the shoe. As a result of this angular orientation of a wearer's foot, her body weight is thrust forward toward her toes or the balls of her feet. This angled orientation is known to cause arthritics and other pathological changes in the foot. These changes include equinas, hammer toes, bunions, jamming of toe joints, soft corns, callouses, tailor's bunions, neuromas and other nerve compression syndromes.

In addition, many people suffer from foot deformities, either naturally occurring or as a result of other circumstances such as surgery. Foot deformities may make wearing a high fashion (high-heeled) shoe extremely uncomfortable, if not painful or even impossible. Persons suffering from foot problems have often been restricted to orthopedic footwear in which the actual supporting portion of the shoe is generally flat or horizontally oriented.

Some foot problems may be tempered by orthotic devices, such as inserts or arch supports, which may be inserted into a wearer's shoes. Orthotic devices may be either prescribed by a doctor or purchased over the counter. While such devices may fit into a conventional flat shoe, they may not be compatible with the contour of a high-heeled shoe. The device may "rock" when placed in a high-heeled shoe, or other problems may develop causing the device to, at the very least, lose its effectiveness in correcting the foot problem.

Furthermore, even simple every day walking may be painful due to the lack of shock absorption in most high fashion shoes. Without the inclusion of a shock absorbing material in a shoe, a wearer is constantly pounding her joints against the walking surface. Although running shoes have been developed to absorb shock, most high-heeled shoes are not designed for this purpose. For this reason, women have turned to wearing jogging shoes with business suits and other high fashion attire, for instance, while traveling to and from their workplaces.

Still further, many high-heeled shoes have pointed, rather than round, toe areas and low toe boxes (i.e. the height of the part of the shoe covering a wearer's toes). Such geometry does not conform with the anatomy of the foot and may cause foot pathology from compression. Common conditions include neuromas, ingrown toenails and soft corns.

These and other characteristics of high fashion shoes have forced people with foot problems to confine themselves to flat footwear. Additionally, women without physical restrictions due to foot problems, may avoid high-heeled shoes to prevent the problems these shoes are known to cause. Furthermore, even women without medical concerns, may, for personal reasons, sacrifice the fashion of a high-heeled shoe for the comfort and secure support of flat footwear.

In the past various attempts have been made to improve support and comfort characteristics of footwear. Some of these attempts have included the provision of supports, cushions, and modified toe boxes. Other attempts have included specially designing portions of the shoe. However, despite these attempts, a continued need remains for high fashion footwear providing improved support and comfort.

SUMMARY OF THE INVENTION

The present invention provides the comfort and secure support of a flat or a substantially flat shoe while preserving the aesthetics of a high fashion shoe. The invention is characterized by a shoe which creates the optical illusion that a wearer's foot is supported at an angle, while the foot is really comfortably contained on a substantially flat surface. Thus the present invention provides a shoe with a fashionable, desirable appearance, however without the disadvantages of a conventional high-heeled shoe.

A shoe according to the present invention has a sole, extending the length of the entire bottom surface of a wearer's foot. A heel is joined with, and extends perpendicularly downward from the sole. As in a conventional high-heeled shoe, the heel and a front portion of the sole will contact the walking surface. An intermediate portion of the sole, i.e. between the front portion of the sole and the heel, will be elevated above the walking surface. However, a shoe according to the present invention will have an elevated front sole portion whereby the wearer's forefoot will be supported at the same level as the heel.

Although the wearer's foot is supported on a flat surface, the shoe is constructed with certain features to create the optical illusion that the wearer's foot is supported at an angle. Specifically, the shoe is designed to make the elevated front portion of the shoe appear thinner, and the front supporting area lower, than it actually is. The shoe is also constructed to make the supporting surface of the heel appear to be higher than it actually is.

To make the elevated front portion of the shoe appear thinner, the bottom side edges of the front sole are beveled inward. These beveled edges help to visually reduce the bulk of this portion of the shoe. Additionally, an upper front portion of the shoe is attached between an upper and lower layer of midsole, creating the appearance that a wearer's forefoot is resting on the lower midsole layer although it actually rests on the upper (and higher) midsole layer. This method of attachment makes the front supporting area seem lower than it actually is.

The optical illusion of a sloped shoe is furthered by features causing the supporting area of the heel to appear higher than it actually is. The heel is covered with a material, such as leather, preferably matching the material of an upper rear portion. Instead of the heel-covering material terminating at the top of the heel, it overlaps a part of the upper rear portion, terminating at a slanted seam. This construction creates the illusion that the wearer's heel rests on the same level, and at the same angle, as the slanted seam rather than on top of the heel. The illusion is also aided by the design of the rear wall of the upper rear portion, which extends higher than that of a conventional shoe, giving the illusion that the heel is resting above the forefoot. The desired illusion is also enhanced by the side walls of the upper rear portion. The side walls are sloped downward from the rear wall to an intermediate portion of the sole, helping to visually create the appearance that a wearer's foot is supported at an angle, rather than on a flat surface.

A shoe according to the present invention also includes characteristics making it anatomically correct and thus more comfortable and secure than conventional high heels. The shoe is compatible with orthotic devices because these devices may be easily inserted into the shoe. The sole may include a shock absorbing material such as ethyl vinyl acetate (EVA). The shoe is also designed with a high toe box and a rounded toe area to conform to the shape of the foot. These and other features contribute to the comfort of the shoe and the promotion of a healthy foot.

To make a shoe according to the present invention, a conventional last is altered so that the shoe will have a sunken heel. An upper midsole layer and a lower midsole layer are formed from a suitable material, preferably a shock absorbing material such as ethyl vinyl acetate (EVA). The upper midsole layer is shaped to extend the entire length of a wearer's foot. The lower midsole layer is shaped to conform with the wearer's forefoot and arch, or the portion of the foot excluding the heel. An upper front portion and an upper rear portion are cut from the desired material and are secured to the bottom surface of the upper midsole layer. A conventional heel (i.e. the same type of heel which is used in a conventional high-heeled shoe) is then secured to the bottom surface of the upper midsole layer. After the heel is secured, it is covered with a material, preferably leather and preferably matching the material of the upper rear portion. The heel-covering is extended above the heel so that it overlaps a section of the upper rear portion of the shoe and terminates at a slanted seam line. The lower midsole layer is then secured to the upper midsole layer, whereby the secured section of the upper front portion will be sandwiched between the two midsole layers.

To the accomplishment of the foregoing and related ends, the invention, then, comprises the features hereinafter fully described and particularly pointed out in the claims. The following description and the annexed drawings set forth in detail a certain illustrative embodiment of the invention. This embodiment is indicative, however, of but one of the various ways in which the principles of the invention may be employed.

DETAILED DESCRIPTION OF THE INVENTION

Figure 1:
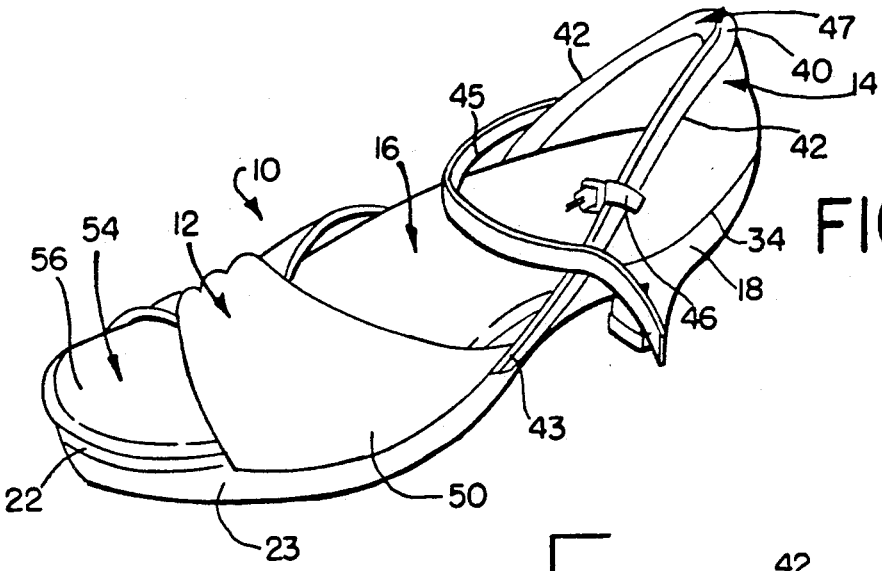
FIG. 1 is a front prospective view of a shoe in accordance with the present invention.
Figure 2:
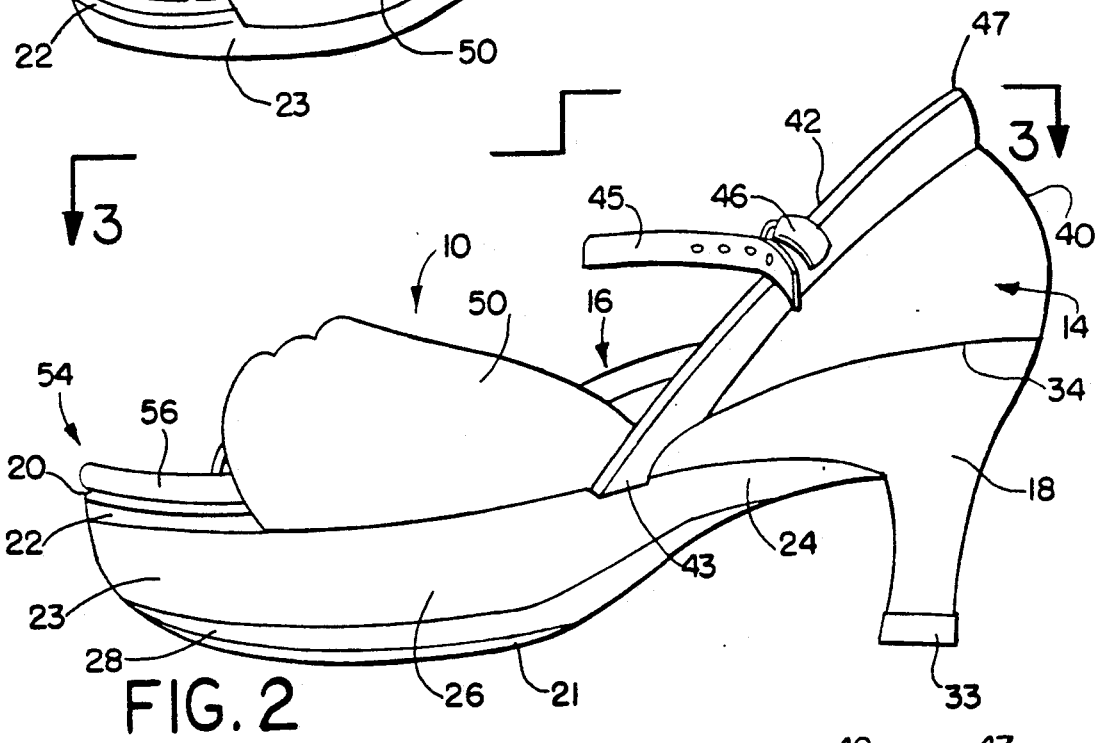
FIG. 2 is an elevation view of the shoe of FIG. 1.

Referring in detail to the drawings, wherein like reference numerals designate like parts in the several figures, and initially to FIG. 1, a perspective view of an assembled shoe 10 is shown. The shoe 10 includes an upper leather front portion 12, an upper leather rear portion 14, a sole portion 16 and a heel 18. The sole portion 16 extends the length of the shoe 10. Relating the sole portion 16 to parts of a wearer's foot, the sole portion will contact the toes, the ball of the foot, the arch and heel. The toes and the ball of the foot are sometimes referred to collectively as the forefoot. The heel 18 is joined with, and extends perpendicularly downward from, a rear end, or heel section of the sole portion. The geometry and construction of these portions create the optical illusion of a high-heeled shoe although they also cooperate to provide a substantially flat horizontal surface on which a wearer's foot may be supported.

Referring now additionally to FIGS. 2–6, the sole portion 16 includes two midsole layers: an upper midsole layer 22 and a lower midsole layer 23. The midsole layers 22 and 23 are preferably made from ethyl vinyl acetate (EVA) which functions as a shock absorber and is commonly used in jogging shoes. The front, or toe sections, of the layers are preferably formed with a rounded toe area to better conform with the anatomy of a wearer's foot and prevent squeezing of the toes.

The upper midsole layer 23 extends over the entire sole portion 16 of the shoe, maximizing the shock absorbing function of the midsole. The upper midsole layer 23 is approximately the same thickness throughout its length. The upper midsole layer 23 is attached to a leather inner sole 20 forming the structural part of the sole portion 16.

The lower midsole layer 22 extends only over the forefoot and arch portions of the sole portion 16, or the portion of the sole excluding the heel. The lower midsole layer 22 includes a tapered section 24 which tapers back to a thin layer 25 towards the heel 18. At the opposite end, or the toe end, the lower midsole layer 22 has a relatively thick section 26. The thick section 26 includes a bevel, or offset area, 28 which is angled inward towards the bottom edges of the lower midsole layer 22. The bevel 28 visually decreases the height or thickness of the thick section 26 by hiding a part of the lower midsole layer 22 from an observer's line of sight. This visual decrease in height helps to further the illusion that the sole supporting area is lower than the heel supporting area of the shoe 10.

A shock reinforcing bar (not shown) may be sandwiched between the upper midsole layer 22 and the lower midsole layer 23. The bar may extend from the heel to the arch, thus supporting the portion of the shoe which does not contact the walking surface, and adding stability to the shoe.

The sole portion 16 also includes an outer sole 21. The outer sole 21 is preferably a thin sheet of gum rubber cut to conform to the shape of the front sole portion 16. The outer sole 21 extends from the front, or toe section of the sole portion 16 to a location designated by a line 17 seen in FIG. 6. This gum rubber outer sole 21 provides excellent grip on a walking surface and prevents slipping.

The heel 18 is made of plastic, rubber or any other suitable material. The heel 18 may be of the same type as is used on a conventional high-heeled shoe, no special design is necessary to accommodate the objectives of the invention. The heel may be of any desirable height, however most high heels exceed at least one inch in height, that is, raise the heel portion of the foot at least one inch off the walking surface. A tab 33 is attached to the bottom surface of the heel 18. The tab 33 is preferably replaceable to increase the useful life of the shoe.

Figure 3:
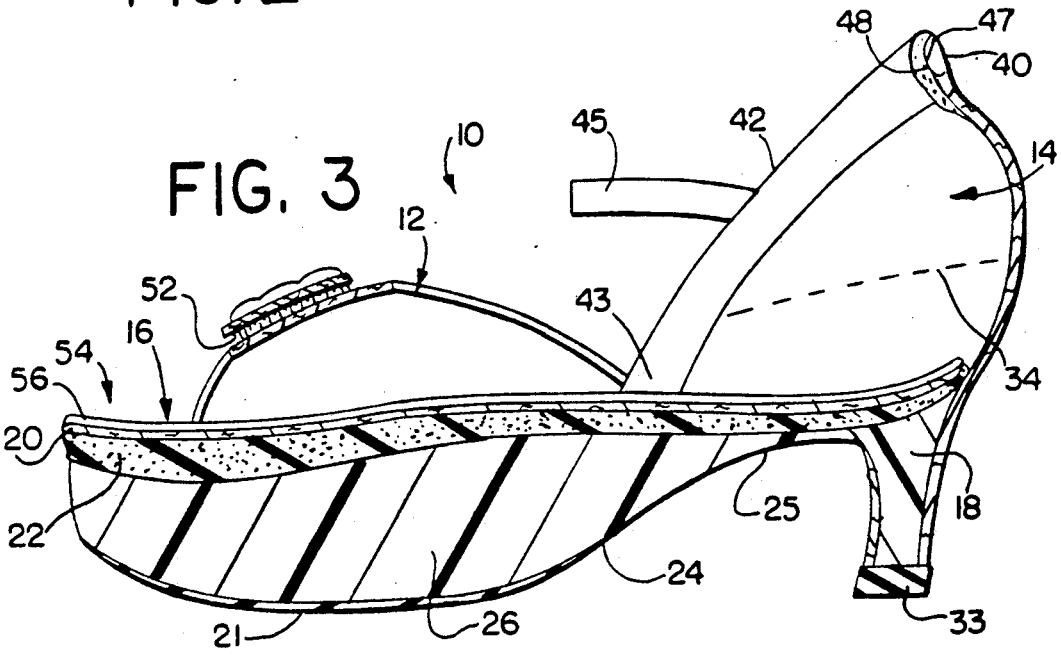
FIG. 3 is a section view taken from line 3—3 in FIG. 2.
Figure 4:
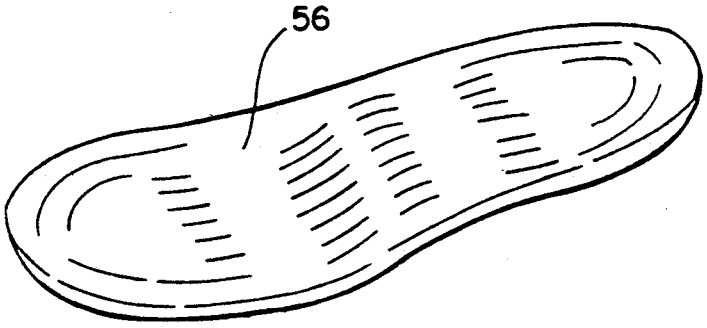
FIG. 4 is a plan view of an orthopedic pad support used in the shoe.
Figure 5:
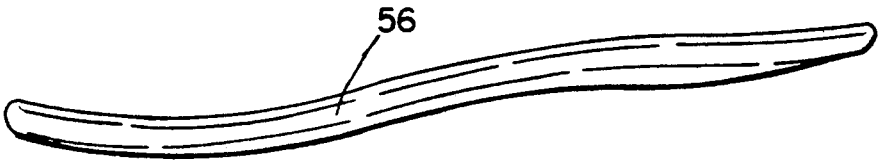
FIG. 5 is an elevation of the orthopedic pad support.
Figure 6:
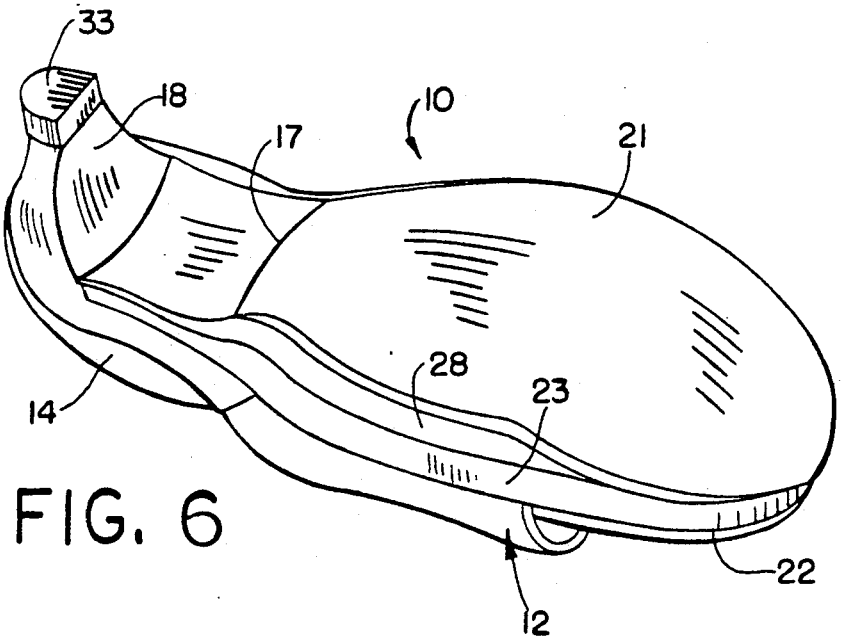
FIG. 6 is a perspective view of the shoe looking at the bottom surface.

The heel 18 appears to extend up to a sloped seam line 34 from an exterior view of the shoe. (See FIG. 2). However, as is best seen in FIG. 3, the heel 18 terminates slightly below the dashed seam line 34. This illusion is created by covering the heel 18 with a material, preferably leather and preferably matching the material of the upper rear portion. The heel-covering extends upward beyond the top of the heel and overlaps a part of the upper rear portion 14 before terminating at the sloped seam line 34. If the heel 18 is covered with the same leather as the upper rear portion 14 the shoe will have a better blending of colors and textures. A heel cup (not shown) may be placed in the shoe 10 to prevent breakdown of the shoe 10 and to give rear foot stability. The heel cup is preferably made of a thermoplastic material for good strength and minimum weight.

The upper front portion 12 of the shoe 10 is sandwiched between the upper midsole layer 22 and the lower midsole layer 23. By this method of attachment, the thickness of the elevated midsole, i.e., the upper midsole layer 22, is at least partially covered by the upper front portion 12. An illusion is created that the wearer's foot rests on the lower layer 23 of the midsole rather than the upper layer 22. The midsole layers 22 and 23 may be painted a color matching the leather of the upper front portion 12 and the upper rear portion 14. Such painting also helps subtract from the height of the thick portion 26 by blending it in with the upper front portion 12 of the shoe, and further enhances the appearance of the shoe 10.

The upper front portion 12 of the shoe 10 may be in the form of one or more straps 50. The straps 50 are preferably adjustable for extra accommodation. The straps 50 may be secured together with Velcro fasteners 52. Velcro is a trademark for a nylon material made with both a surface of tiny hooks and a complimentary surface of clinging pile use in matching strips which can be pressed together or pulled apart for easy fastening and unfastening. Other suitable securing devices such as buckles or ties may also be used. The illustrated embodiment will leave a wearer's toes uncovered in area 54, however the upper front portion 12 may also be in the form of a fully covered or enclosed portion. The upper front portion 12 may have added height when compared to a normal shoe, or in other words, a high toe box This added height will accommodate vertical toe deformities. Preferably, the materials and colors of the upper front 12 and the midsole layers 22 and 23 are the same to de-emphasize such height.

The rear upper portion 14 is attached to a bottom surface of the upper midsole layer 22. The upper rear portion 14 of the shoe 10 extends upward from the lower midsole layer 22 to form a generally U-shape cavity for a wearer's foot. The upper rear portion 14 includes a back wall 40 and side walls 42. The side walls 42 are sloped, or angled, downward from the back wall 40 to an intermediate portion 43 of the shoe 10, helping to create the illusion of sloped supporting area. Specifically, the slanted side walls 42 present the appearance that the entire shoe 10 is angled in orientation. The height of the back wall 40 may further add to this appearance. In a conventional high-heeled shoe the back wall typically would only extend upward to a location adjacent the wearer's heel. However, the back wall 40 preferably extends substantially above this location to a location adjacent to a distil portion of the wearer's leg. This added height when compared to a conventional shoe helps create the illusion that the heel of the foot is higher than the forefoot.

An ankle strap 45 may be attached to one side wall 42 of the shoe 10, with a corresponding buckle 46 attached to the other side wall 42. The ankle strap 45 and buckle 46 are especially useful to hold the shoe 10 to the foot if a wearer has a narrow heel. The ankle strap will hold the heel in the shoe and prevent slippage of the heel out of the shoe. Alternatively, the rear portion may be designed to sufficiently hug the heel so that securing straps are not necessary. A top portion or edge 47 of the back wall 40 may be filled with padding 48 to prevent irritating rubbing against the wearer's foot. Foam rubber is preferably used for padding 48.

An insert 56 preferably is included in the shoe to provide added cushion effect. The insert 56 may be selectively removed by a wearer, allowing her to substitute an orthotic device prescribed by a doctor or purchased over the counter. The insert 56 may be selectively placed into the shoe and exchanged with other devices if necessary or eliminated all together. The insert 56 is preferably made from a material which accommodates a wearer's sensitive skin and other deformities of the foot, such as painful callouses and prominent bones.

To make a shoe according to the present invention, a conventional last may be used. A last is a wooden or metal form shaped like a human foot. The last positive cast over which a shoe is shaped. When a sole is formed with a conventional last, the sole will be the "negative cast". The negative cast sole will place the heel and the forefoot in the same horizontal plane, as they are in the human foot. When a heel is added, the heel portion of the sole can no longer occupy the same horizontal plane as the forefoot, and the heel portion is elevated as in a conventional high-heeled shoe.

Thus in order to keep the forefoot and the heel portion of the sole on the same horizontal plane after a heel is added, the last must be altered. Specifically, extra cork is added to the bottom surface of the heel portion of the last, so that when a negative cast is made, the heel portion of the sole will be sunken or lower than the forefoot. Thus adding a conventional high heel to the sole will bring the heel portion of the sole back to the same horizontal plane as the forefoot. Note that although the forefoot and heel portion are aligned on the same horizontal plane, the forefoot will be elevated off the ground like the heel portion of the sole. Therefore, the sole portion of the assembled shoe must include a thick or elevated midsole to compensate for this elevation. The last may also be altered in other ways, such as adding extra cork to the sides of the forefoot portion of the last to accommodate foot bunion deformities.

Once the conventional last is altered, a leather inner sole is cast. The negative cast inner sole forms the structural support for the sole portion of the shoe.

An upper rear portion, preferably one with sloped side walls, is drawn on the last so that the shape may be transformed into a paper pattern. Two leather pieces are then traced and cut from the pattern. Reinforcing material may also be cut to be inserted between the two leather pieces to give the upper rear portion rigidity. Foam padding may be placed between the leather pieces along the top rim and stitched in place. The pieces are then assembled in any appropriate manner such as gluing or sewing. An upper front portion is drawn on the last, transformed into a paper pattern, cut from leather and assembled in the same manner as the upper rear portion.

The leather inner sole (the negative cast of the last) is used as a pattern for making two layers of midsole. The layers of midsole are formed from a suitable material, preferably one with shock absorbing abilities such as EVA. Both layers of the midsole are preferably formed with a rounded, rather than a pointed toe portion. The upper midsole layer is formed identical to the leather inner sole, so it will extend the length a wearer's foot, i.e. the forefoot, arch and heel. The lower midsole layer is formed so it will extend only over the arch and forefoot portions of the foot, and not the heel portion. The lower layer is contoured with a thick front forefoot and a tapered section towards the heel in the arch portion. The bottom side edges of the lower midsole layer are beveled inward.

The leather inner sole is glued or otherwise attached to the upper midsole layer. The inner sole may be attached to either the top or bottom surface of the upper midsole layer. The upper rear portion is then attached to the bottom surface of the upper midsole layer. A reinforcing bar may also be attached to the bottom surface of the upper midsole layer in the heel and arch area for structural purposes.

A conventional heel is then glued, or otherwise attached, to the bottom surface of the upper midsole layer. The heel is then covered with leather, preferably the same type as the upper rear portion. The heel covering is extended above the heel and overlaps a part of the upper rear portion of the shoe, terminating at a seam line. The seam line is preferably angled downward towards an intermediate section of the sole portion. The upper front portion is attached to the bottom surface of the upper midsole layer. The lower midsole layer is then glued to the upper midsole layer.

Other items may be added to further the comfort, stability and appearance of the shoe. An insert may be covered with leather to match the upper leather portions of the shoe and placed into the shoe. Additionally, the bottom surface of the lower midsole layer may be covered with a gum rubber outersole for better gripping. A replaceable tap may be placed on the bottom of the heel to increase the useful life of the heel. Ankle straps may be attached to the upper rear portion for securing the shoe to a wearer's foot. The midsole layers may be painted the same color as the leather uppers to further enhance the shoe's appearance.

From the foregoing description, it can be appreciated that a shoe according to the invention may provide secure support for a wearer, while providing a fashionable appearance and comfort. A wearer will have a feeling of comfort, secure support and confidence in being stylish.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the following claims.

We claim:

1. A high-heeled shoe comprising:
a sole portion forming a supporting area for a wearer's foot;
a heel joined with said sole portion extending perpendicularly downward at least an inch from said sole portion;
said sole portion and said heel portion having a forefoot area, an arch area and a heel area;
securing means for selectively securing said sole portion to a wearer's foot;
said forefoot area elevated to a level substantially horizontal with said heel area whereby said supporting area is generally flat;
wherein said sole portion includes an upper midsole layer and a lower midsole layer;
wherein said layers comprise sections made from ethyl vinyl acetate material;
wherein said securing means comprises an upper front portion and an upper rear portion; and
wherein said lower midsole layer includes a thick section tapering into a thin layer adjacent to said heel.

2. A high-heeled shoe as set forth in claim 1 wherein said thick section of said lower midsole layer includes an inwardly angled offset at a surface of said layer.

3. A high-heeled shoe as set forth in claim 2 wherein a part of said upper front portion is secured between said upper midsole layer and said lower midsole layer whereby said part is sandwiched between said upper midsole layer and said lower midsole layer.

4. A high-heeled shoe as set forth in claim 3 wherein said upper rear portion comprises a generally U-shape cavity including a back wall and two tapered side walls.

5. A high-heeled shoe as set forth in claim 4, wherein said upper rear portion extends substantially above a location adjacent to a wearer's heel to a location adjacent to a distil portion of the wearer's leg.

6. A high-heeled shoe as set forth in claim 4 further wherein said upper rear portion includes foam rubber padding attached to an upper part of said back wall.

7. A high-heeled shoe comprising:
a sole portion forming a supporting area for a wearer's foot;
a heel joined with said sole portion extending perpendicularly downward at least an inch from said sole portion;
said sole portion and said heel portion having a forefoot area, an arch area and a heel area;
securing means for selectively securing said sole portion to a wearer's foot;
said forefoot area elevated to a level substantially horizontal with said heel area whereby said supporting area is generally flat;

wherein said sole portion includes an upper midsole layer and a lower midsole layer;

wherein said layers comprise sections made from ethyl vinyl acetate material;

wherein said securing means comprises an upper front portion and an upper rear portion; and wherein said heel is covered with a covering extending above said heel and overlapping a lower part of said upper rear portion and said covering terminates at a seam line above said heel; said seam line angled downward towards said forefoot area.

* * * * *